US005194677A

United States Patent [19]

Schuemann

[11] Patent Number: 5,194,677

[45] Date of Patent: Mar. 16, 1993

[54] HANDGUN GRIP SAFETY

[76] Inventor: Wilfred C. Schuemann, 705 Wagner Dr., Carson City, Nev. 89703

[21] Appl. No.: 817,669

[22] Filed: Jan. 7, 1992

[51] Int. Cl.[5] ..... F41C 23/10

[52] U.S. Cl. ..... 42/71.02; 42/7

[58] Field of Search ..... 42/71.02, 70.08, 70.04, 42/70.5, 70.6, 7; 89/148, 150

[56] References Cited

U.S. PATENT DOCUMENTS 926,529 6/1909 Wesson ..... 42/71.02

939,882 11/1909 Whiting ..... 89/150

1,082,969 12/1913 Nelson ..... 89/148

1,839,830 1/1932 Brotherson ..... 42/7

4,841,840 6/1989 Agner et al. ..... 42/70.08

*Primary Examiner*—Michael J. Carone

*Attorney, Agent, or Firm*—Cahill, Sutton & Thomas

[57] ABSTRACT

A grip safety for use in a Model 1911-type semiautomatic pistol having a staggered double-column magazine includes a grip safety having extensions for filling the posterior ends of slots accommodating translational movement of the trigger body.

21 Claims, 2 Drawing Sheets

HANDGUN GRIP SAFETY

BACKGROUND OF THE INVENTION

1. Field of the Invention

The present invention relates to handguns and, more particularly, to a grip safety for a semiautomatic handgun.

2. Description of Related Art

A semiautomatic handgun developed for the army in 1911 is often referred to as a Model 1911. This handgun was extremely well designed to operate in adverse environments and fire with great accuracy projectiles having high kinetic energy at point of impact. Numerous variations have been developed over the years, both in details of construction and with calibers different from the initial 0.45 caliber bore.

One popular variant is known as Model 1911A1. This variant uses a single column magazine in which the rounds are stacked linearly on top of one another. A one-piece trigger includes a trigger bow and a trigger bow centrally apertured to surround the magazine. The trigger body transfers the trigger finger motion linearly posteriorly around the magazine. The trigger bow translates fore and aft in opposed facing slots formed in opposed internal sides of the grip handle. During assembly of the handgun, the trigger is inserted through an opening in the rear of the grip handle and advanced forwardly within these slots. The opening is covered by mounting a grip safety into the opening at the rear of the grip handle. The grip safety may include a rearwardly extending shield to prevent the user's hand from interfering with or be injured by pivotal movement of the rearwardly and downwardly pivoting hammer and to prevent injury during rearward movement of the slide.

SUMMARY OF THE INVENTION

In a Model 1911 variant semiautomatic handgun, the grip handle is widened to accommodate insertion of a staggered double-column magazine. The rearward ends of opposed facing slots in the grip handle, which slots accommodate translatory movement of the trigger body, are filled with extensions from a grip safety upon installation of same for reasons of safety, comfort and reliability. A rearwardly extending shield of the grip safety includes a depression for receiving the downwardly pivoting hammer to place the shield as high as possible along the grip of the handgun.

It is therefore a primary object of the present invention to provide a grip safety for closing the posterior ends of the trigger body receiving slots in a semiautomatic handgun.

Another object of the present invention is to use a grip safety for closing the posterior ends of opposed trigger body slots in a handgun.

Still another object of the present invention is to provide apparatus for closing the exposed rear ends of trigger body slots in a semiautomatic handgun without adding to the number of parts which must be disassembled during field stripping of the handgun.

Yet another object of the present invention is to provide a shield extending from the grip safety of a semiautomatic handgun which accommodates pivotal movement of the hammer without significantly reducing the effective length of the grip handle.

A further object of the present invention is to provide a multifunctional grip safety for a semiautomatic handgun.

A still further object of the present invention is to provide a grip safety for closing the posterior ends of trigger body slots in a semiautomatic handgun having a staggered double column magazine.

A yet further object of the present invention is to provide a method for closing the posterior ends of the trigger body receiving slots in a semiautomatic handgun.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

Figure 1:
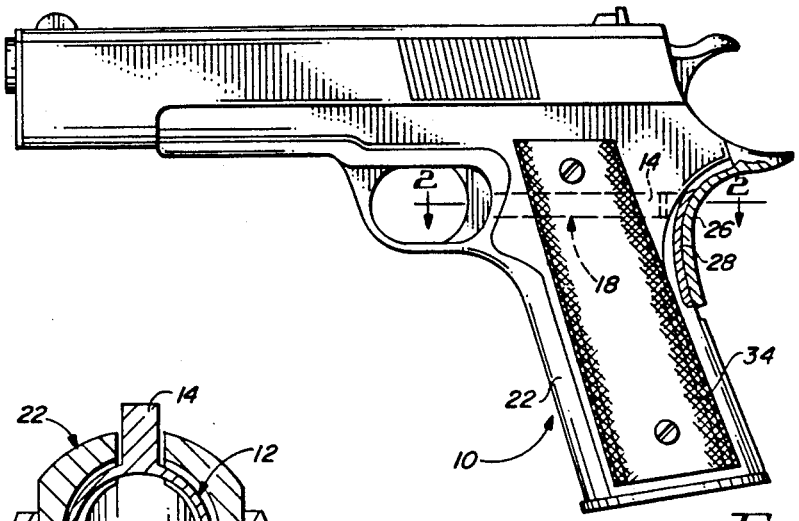
FIG. 1 (PRIOR ART)
FIG. 1 is an elemental side view of a prior art semiautomatic gun having a conventional grip safety.
Figure 2:
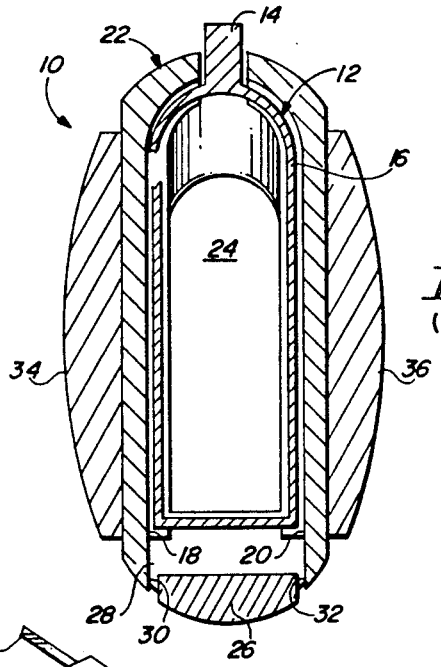
FIG. 2 (PRIOR ART)
FIG. 2 is a partial cross-sectional view taken along lines 2—2, a shown in FIG. 1.

Referring to FIGS. 1 and 2, typical semiautomatic handgun 10 of the type known generically as Model 1911 or Model 1911-A1 is shown. It utilizes a single column magazine wherein the rounds are stacked linearly on top of one another. A one-piece unit 12 formed of a trigger bow 14 and a trigger body 16 is slidably engaged by opposed facing slots 18, 20 extending fore and aft within grip handle 22. As may be noted, trigger body 16 surrounds a typical single column magazine 24 removably disposed within grip handle 22. A grip safety 26 is inserted within opening 28 defined by opposing interior sides 30, 32 of grip handle 22. It may be further noted that the width defined by sides 30, 32 is sufficient to accommodate both trigger body 16 and magazine 24. As is conventional, grip panels 34, 36 are disposed on opposed sides of the grip handle.

The trigger body serves the function of transferring the motion of the trigger bow linearly around the magazine. During assembly of the handgun, one piece unit 12 composed of the trigger bow and trigger body is inserted through opening 28 into engagement with opposed facing slots 18, 20 and advanced forwardly. The rear end of the trigger body and opening 28 are covered upon attachment of grip safety 26.

Figure 5:
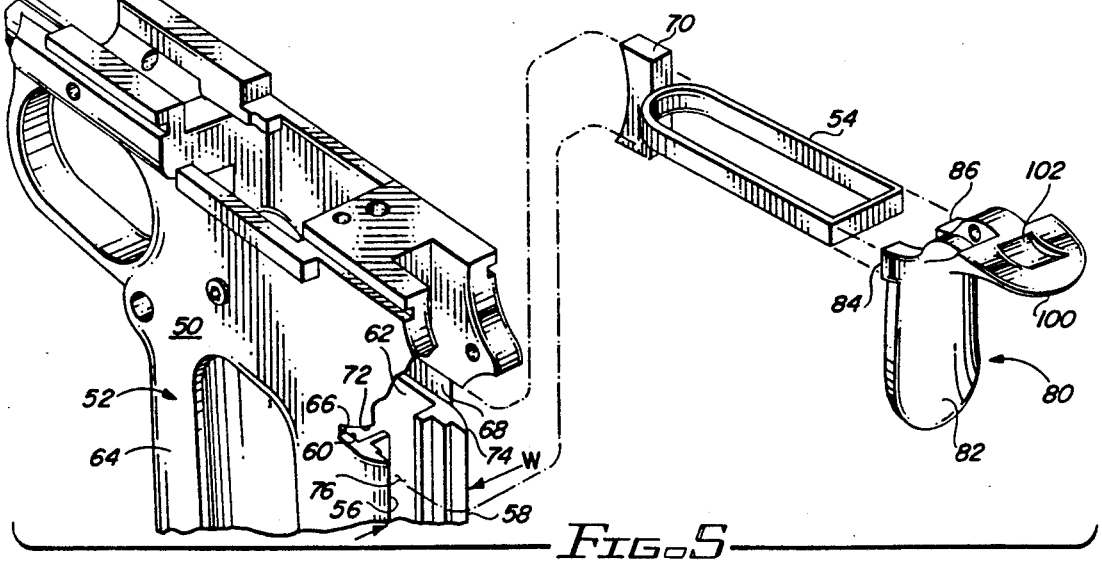
FIG. 5 is an exploded isometric view illustrating a portion of the handgun frame, the trigger and the grip safety.
Figure 3:
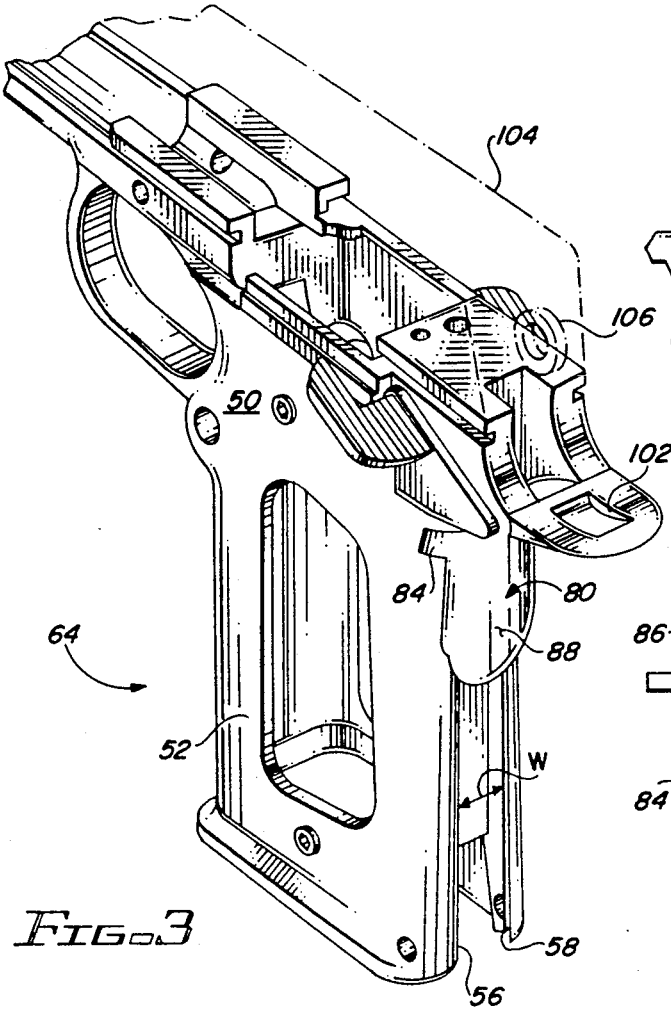
FIG. 3 is an isometric view of the frame of a semiautomatic handgun.
Figure 6:
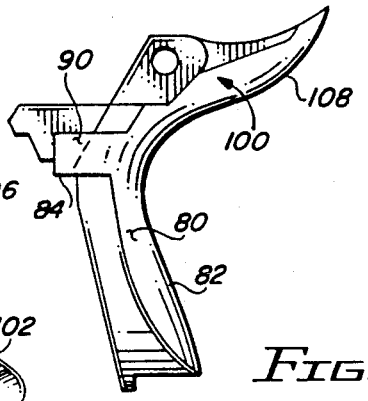
FIGS. 6, 7 and 8 illustrate the left side view, top plane view, and rear elevated view of a grip safety.
Figure 7:
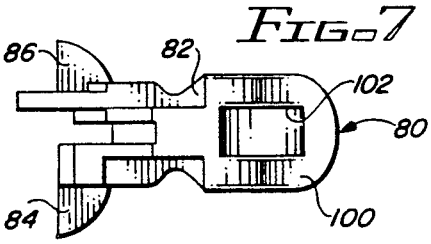
Figure 8:
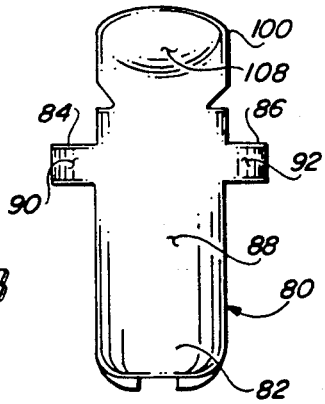
Figure 4:
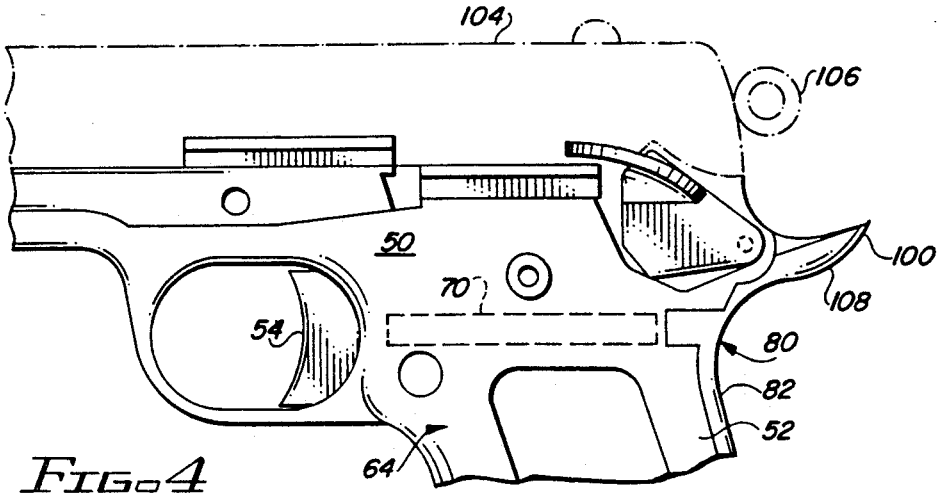
FIG. 4 is a partial side view of the handgun frame.

Referring jointly to FIGS. 3, 4 and 5, there is shown a semiautomatic Model 1911 (or Model 1911-A1 handgun 50 having a grip handle 52 adapted to receive a staggered two-column magazine, sometimes referred to as a high capacity magazine. Such a magazine is wider than the conventional magazine and requires a grip handle wider than that of more conventional handguns of this type. To accommodate the wider magazine, trigger bow 54 (see FIG. 5) must be apertured with a wider opening than the more conventional trigger body to accommodate the wider magazine. Rear edges or flanges 56, 58 of grip handle 52 curve inwardly toward one another to define a standard width W therebetween. It may be noted that the width W between flanges 56, 58 is less than the width between sides 60, 62 of the magazine receiving channel of frame 64 and within the grip handle.

Slots 66, 68, extending fore and aft within grip handle 52 and upwardly of the magazine must be spaced apart in a facing relationship a sufficient distance to accommodate fore and aft translation of trigger bow 54. Trigger bow 54, having trigger body 70 formed a unitary part thereof, is necessarily substantially wider than the width defined by flanges 56, 58. These dimensional relationships require openings or cut-outs 72, 74 in inwardly turned flanges 56, 58 to accommodate the slots.

A conventional grip safety, such as grip safety 26 shown in FIGS. 1 and 2, would only be capable of filling opening 76 between flanges 56, 58. This would result in rectangular shaped openings commensurate with the cross-section of slots 66, 68 being disposed on opposed sides of the grip safety. Such openings would have a negative impact upon comfort of the user, safety to the user, potential for intrusion of foreign matter, and reliability. The solution proposed herein includes that of forming opposed handgrips attached to grip handle 52 to include extensions penetrably insertable within cutouts 72, 74. This solution necessarily requires removable and reassembly of the handgrips each time the handgun is to be field stripped. Such disassembly and reassembly is unnecessary, creates a situation for potential loss of parts, reduces the likelihood of using aftermarket handgrips more comfortable to the user, and requires handgrips with an easily broken off extension.

To solve the problem of exposed cut-outs 72, 74, grip safety 80 was developed, as particularly illustrated in detail in FIGS. 5, 6, 7 and 8. Grip safety 80 includes a conventionally configured body 82 for penetrable engagement within opening 76 intermediate flanges 56, 58. A pair of extensions 84, 86, rectangular in vertical cross-section, are configured to penetrably engage slots 66, 68 disposed in flanges 56, 58. Upon such engagement, or openings 72, 74 created by these two slots will become closed.

To provide comfort to a shooter, back surface 88 of grip safety 80 is contoured to carry through the curvature of the posterior opposed sides of grip handle 52. Additionally, faces 90, 92 of extensions 84, 86 are contoured to mate with the contour of the respective adjacent surfaces of the grip handle. Grip safety 80 thereby provides all the benefits of a conventional grip safety and it closes the open posterior openings or cut-outs or openings 72, 74 formed by slots 66, 68 disposed in grip handle 52. Upon field stripping or partial disassembly, the opposed grip panels (such as grip panel 72 shown in FIG. 1) need not be disassembled.

Most grip safeties for handguns of the type described herein include a rearwardly extending upwardly located shield to prevent the user's hand from interferingly engaging with the hammer and from being positioned too high and interfering with rearward movement of slide 104 (see FIGS. 3 ad 4). To permit a user's hand to be as high up on grip handle 52 as possible, shield 100 of grip safety 80 includes a depression 102 formed therein for receiving knob 106 of the hammer. This depression permits undersurface 108 of shield 100 to be as high as possible without impeding arcuate movement of the hammer and its associated knob 106. The user's hand is thereby protected against injury due to rearward movement of slide 104 and against injury by knob 106 due to downward arcuate movement of the hammer.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

What is claimed is:

1. A grip safety for protecting the hand of a user of a semiautomatic handgun having a grip handle and a trigger bow extending from a trigger body, which trigger bow is slidably located within opposing facing slots disposed within the grip handle and extending to the posterior of the grip handle and defining slot openings disposed on opposed sides of a central opening at the rear of the grip handle, said grip safety comprising in combination:

a) a body for closing the central opening in the grip handle;

b) a first extension extending from one side of said body for penetrable mating with the slot opening disposed at the posterior end of one of the slots; and c) a second extension extending from the other side of said body for penetrable mating with the slot opening disposed at the posterior end of the other of the slots.

2. The combination of claim 1, wherein the handgun includes a rearwardly and arcuately positionable hammer and wherein said grip safety includes a rearwardly extending shield extending rearwardly past the hammer for shielding a user's hand against contact with the hammer.

3. The combination of claim 2, wherein said shield includes an indentation for receiving a part of the hammer.

4. The combination of claim 2, wherein the handgun includes a reciprocating rearwardly extendable slide manually actuatable or actuated upon firing of the handgun and wherein said shield is disposed below the slide upon rearward movement of the slide to protect the user's hand from injurious contact with the slide upon firing of the handgun.

5. The combination of claim 1, wherein each of the slot openings is rectangular in lateral cross-section and wherein each of said extensions is rectangular in vertical cross-section and dimensionally corresponding with the respective one of the slot openings.

6. The combination of claim 1, wherein the rear surface of said grip safety is curved to mate with the adjacent opposed surfaces of the grip handle upon seating of said grip safety when the grip handle is manually gripped.

7. The combination of claim 6, wherein each of said first and second extensions includes a rear surface defining a continuation of the rear surface of said body and each of said first and second extensions being contoured in correspondence with the surface of the grip handle adjacent the respective slot opening.

8. A grip safety for closing the posterior openings formed by a pair of posteriorly extending opposed slots, which slots accommodate rectilinear translation of a trigger bow extending from a trigger body and disposed within a grip handle of a semiautomatic handgun and which openings are on opposed sides of a posterior central opening disposed at the rear of the grip handle, said grip safety comprising in combination:

a) first means for closing the central opening in the grip handle;

b) second means for closing the posterior opening of one of the pair of slots; and c) third means for closing the posterior opening of the other of the pair of slots.

9. The combination of claim 8, wherein each of said second and third closing means is penetrably disposed in the respective one of the posterior openings.

10. The combination of claim 9, wherein each of said second and third closing means is contained within the respective one of the slots.

11. The combination of claim 8, wherein said first closing means fills the central opening in the grip handle.

12. The combination of claim 8, wherein at least one of said second and third closing means fills the posterior end of the respective one of the pair of slots.

13. The combination of claim 8, wherein at least one of said second and third closing means is disposed essentially completely within the the respective one of the pair of slots.

14. The combination of claim 8, wherein the handgun includes a partially exposed rearwardly pivotable hammer and wherein said grip safety includes a shield for shielding a user's hand disposed about the grip handle against being struck by the hammer.

15. The combination of claim 14, including a recess disposed in said shield for receiving a part of the hammer.

16. A method for closing with a grip safety the posterior openings formed by a pair of posteriorly extending opposed slots in a grip handle of a semiautomatic handgun on opposed sides of a posterior central opening disposed in the grip handle, which slots accommodate rectilinear translation of a trigger bow extending from a trigger body, said method comprising the steps of:

a) closing the central opening in the grip handle with the grip safety;

b) closing the posterior opening of one of the pair of slots; and c) closing the posterior opening of the other of the pair of slots.

17. The combination of claim 16, wherein said steps of closing the posterior openings of the pair of slots includes the step of filling the posterior ends of the slots.

18. The combination of claim 16, wherein the handgun includes a rearwardly pivoting hammer and including the step of shielding a user's hand disposed about the grip handle with the grip safety against injurious contact with the hammer.

19. The combination of claim 16, wherein the handgun includes a rearwardly reciprocating slide and including the step of protecting with the grip safety a user's hand disposed about the grip handle against injurious contact with the slide.

20. A safety apparatus, said apparatus comprising in combination:

a) a semiautomatic handgun;

b) a grip handle formed as part of said handgun to be gripped by a user and including a rear surface;

c) a trigger body and trigger bow slidably translatable within said grip handle for firing said handgun;

d) a pair of posteriorly extending opposed slots formed within said grip handle for slidably receiving said trigger bow;

e) a pair of opposed openings disposed in the rear surface of said grip handle corresponding with the rear ends of said pair of slots;

f) a central opening disposed in the rear surface of said grip handle interconnecting with and disposed between said pair of openings;

g) a grip safety disposed within said central opening; and h) a pair of extensions extending from opposed sides of said grip safety for matingly engaging respective ones of said pair of openings.

21. The apparatus as set forth in claim 20 wherein said handgun includes a pivotable hammer and wherein said grip safety includes a shield for protecting the user's hand against injurious contact with said hammer.

* * * * *